US010366589B2

(12) United States Patent
Crowe et al.

(10) Patent No.: US 10,366,589 B2
(45) Date of Patent: Jul. 30, 2019

(54) BUILDING INTRUDER DEFENSIVE SHIELD

(71) Applicant: Crotega, LLC, Crystal, MN (US)

(72) Inventors: Jody Crowe, Eagan, MN (US); Tedd Johnson, Elko, MN (US)

(73) Assignee: CROTEGA, LLC, Crystal, MN (US)

( * ) Notice: Subject to any disclaimer, the term of this patent is extended or adjusted under 35 U.S.C. 154(b) by 0 days.

(21) Appl. No.: 14/475,516

(22) Filed: Sep. 2, 2014

(65) Prior Publication Data

US 2015/0061869 A1 Mar. 5, 2015

Related U.S. Application Data

(60) Provisional application No. 61/873,214, filed on Sep. 3, 2013.

(51) Int. Cl.
*G08B 15/00* (2006.01)
*G08B 15/02* (2006.01)

(52) U.S. Cl.
CPC ..... *G08B 15/02* (2013.01)

(58) Field of Classification Search
CPC ..... G08B 15/00; G08B 13/22; G08B 15/02; G08B 13/1436; G08B 25/008
USPC .... 340/425.5, 426, 540, 541, 552, 573, 627, 340/628, 629
See application file for complete search history.

(56) References Cited

U.S. PATENT DOCUMENTS 5,165,482 A * 11/1992 Smagac ..... A62C 3/0214 169/13
5,311,166 A * 5/1994 Frye ..... G08B 15/00 109/20
5,528,220 A * 6/1996 Woods ..... G08B 15/00 340/540
5,819,124 A * 10/1998 Somner ..... G08B 13/19632 396/263
6,296,808 B1 10/2001 Pearman
8,196,064 B2 6/2012 Krzyzanowski et al.
8,303,905 B2 11/2012 Brents et al.
2008/0111687 A1* 5/2008 Husmann ..... G08B 15/02 340/552

(Continued)

FOREIGN PATENT DOCUMENTS

EP 1433149 A 6/2004

OTHER PUBLICATIONS

"Preventing School Shootings, A Summary of a U.S. Secret Service Safe School Initiative Report", NIJ Journal, No. 248, pp. 11-15, 2002.

*Primary Examiner* — An T Nguyen
(74) *Attorney, Agent, or Firm* — Global IP Counselors, LLP

(57) ABSTRACT

A building intruder defensive system includes a shield module including a tank configured to hold pressurized fluid, a nozzle, and a zone valve connected to the tank and the nozzle, the zone valve being configured to regulate flow of the pressurized fluid from the tank to the nozzle, a sensing device configured to sense presence of an intruder, and to output a signal indicating the presence of the intruder, and a processor programmed to receive the signal from the sensing device as indicating the presence of the intruder, to control the zone valve to cause the zone to open and close so as to spray the pressurized fluid through the nozzle, and to communicate with at least one remote device to deliver system information to at least one of law enforcement and a building occupant.

10 Claims, 7 Drawing Sheets

(56) References Cited

U.S. PATENT DOCUMENTS

| | | | | |
|---|---|---|---|---|
| 2010/0264217 | A1* | 10/2010 | Kumhyr | G08B 15/02 235/400 |
| 2011/0155397 | A1* | 6/2011 | Icove | G01K 11/006 169/43 |
| 2011/0265880 | A1* | 11/2011 | Kim | A62C 35/00 137/1 |
| 2012/0092163 | A1* | 4/2012 | Hart | G08B 19/005 340/541 |
| 2012/0296476 | A1 | 11/2012 | Cale et al. | |

* cited by examiner single nozzle
with domestic
water supply

Multiple nozzle configuration on domestic water supply, not limited to two nozzles Figure 3 Multiple nozzle module on domestic water supply, not limited to two zone valves Single nozzle with
Fire Sprinkler water supply

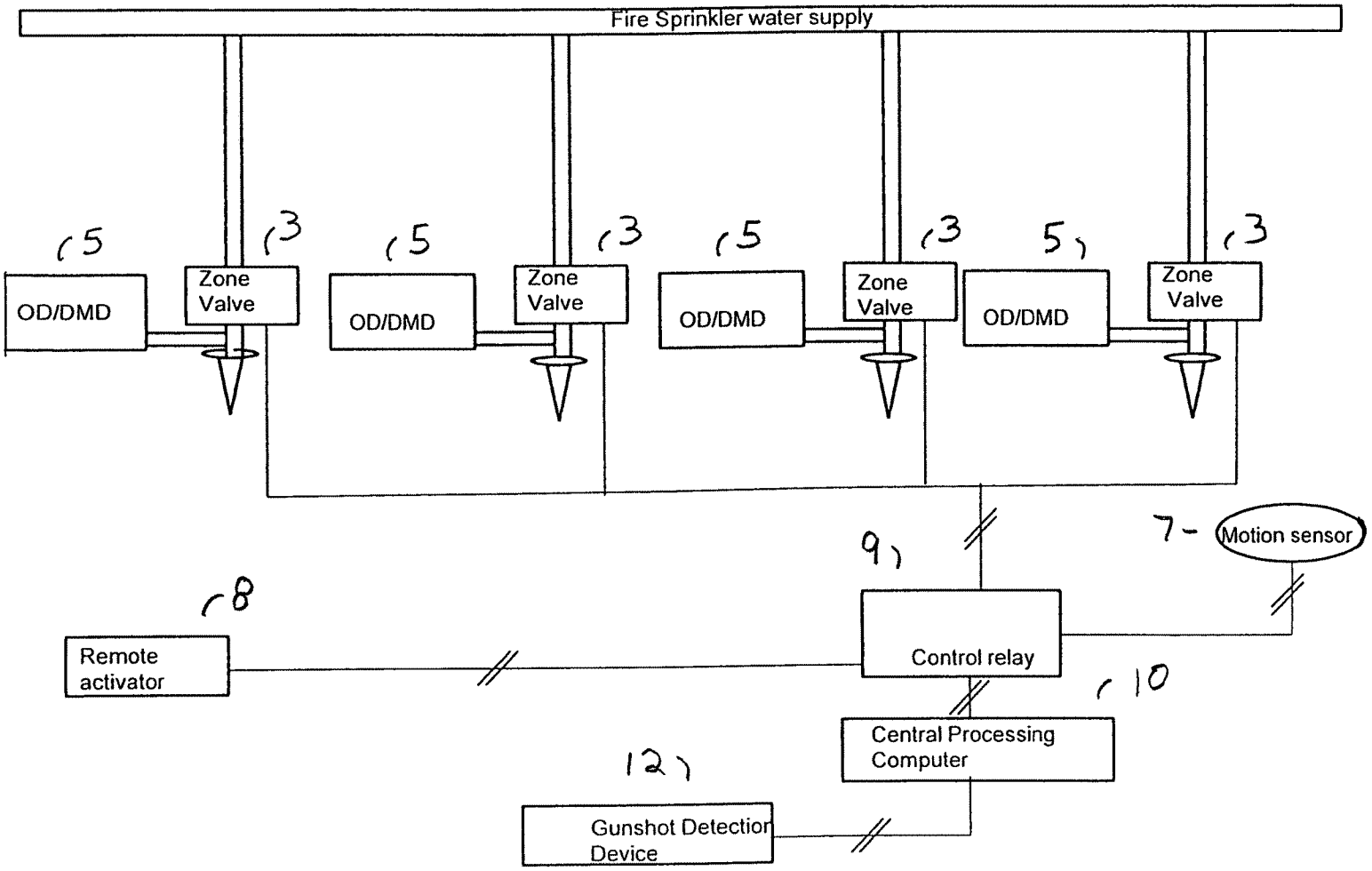
Figure 5 Multiple nozzle module, not limited to four nozzles, with Fire Sprinkler water supply

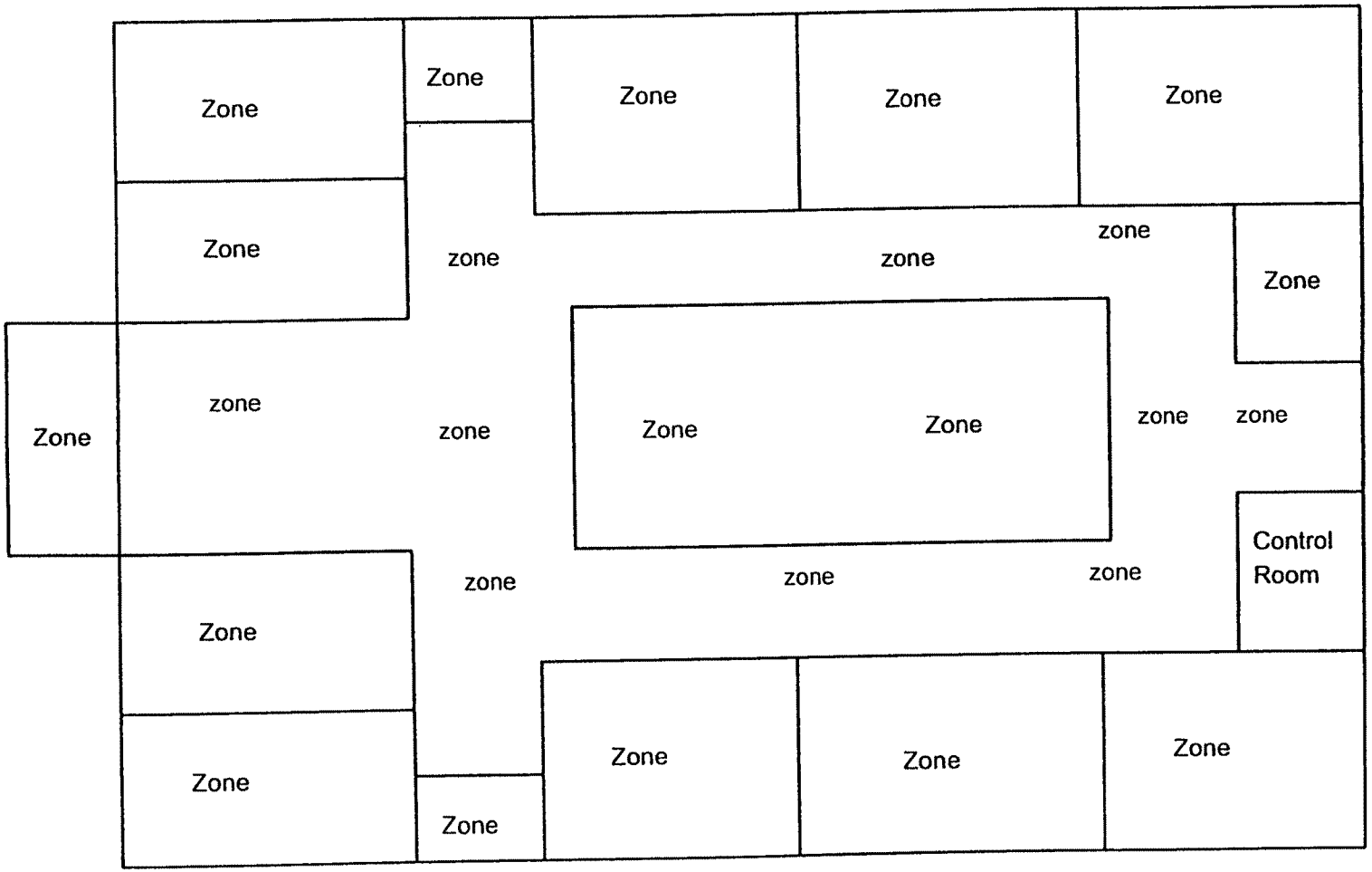
Figure 6 Example—Building footprint with full Building Intruder Defensive Shield coverage

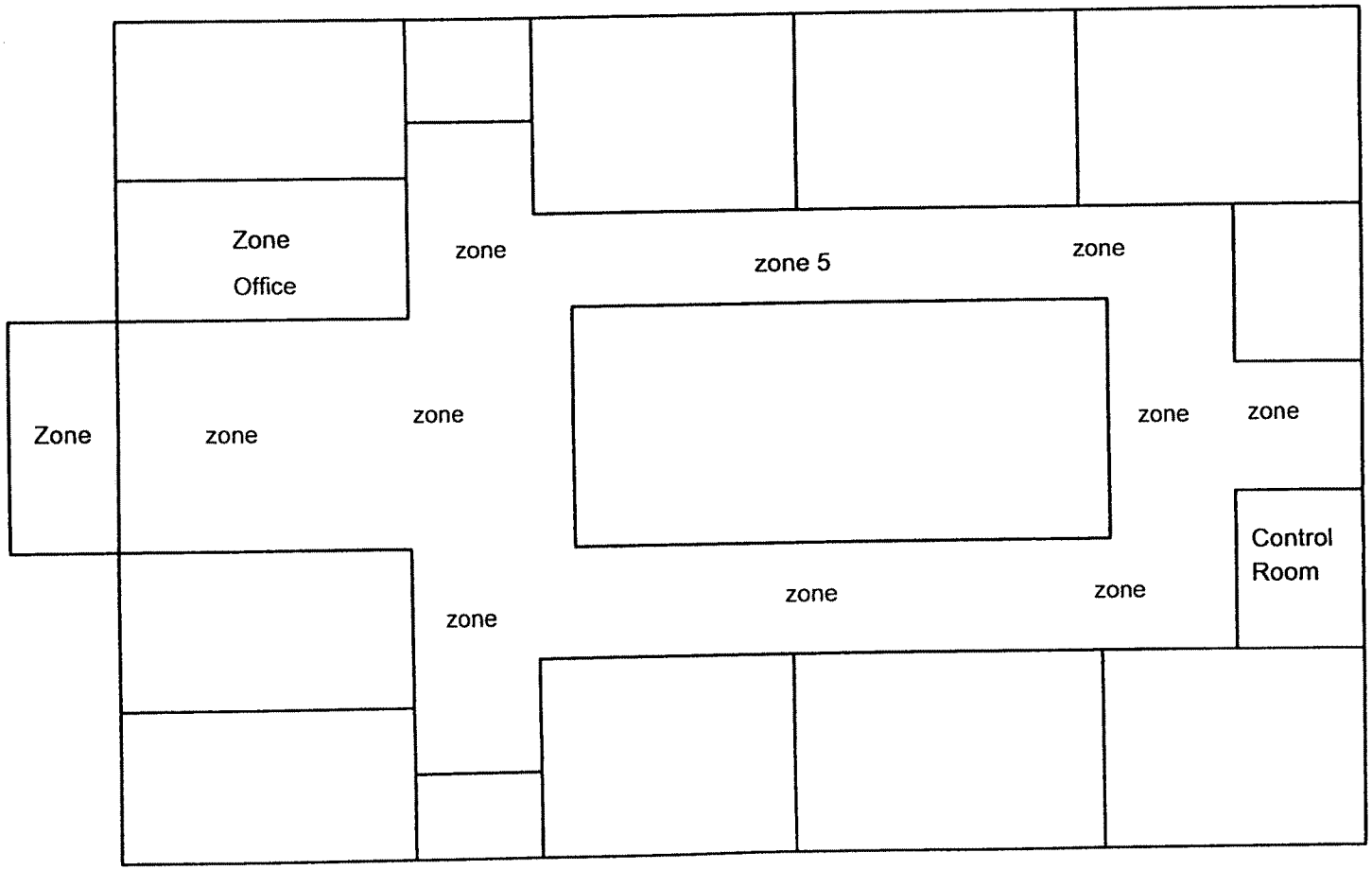
Figure 7 Example—Building footprint with entrance and hallway Building Intruder Defensive Shield coverage

BUILDING INTRUDER DEFENSIVE SHIELD

This application claims the filing date of and relates to the provisional application by the same inventors, Ser. No. 61/873,214 filed on Sep. 3, 2013.

BACKGROUND OF THE INVENTION

Field of the Invention

This invention relates to a defensive shield system to deter, delay and distract intruders from causing damage or harm upon entering and roaming buildings.

Many buildings have systems to suppress fires until the fire department arrives, but none have a system inside the building to suppress active shooters who breech protected or unprotected entrances or who become active when inside of buildings. The unprotected interior of buildings gives an active shooter or any violent perpetrator unfettered access to victims, a veritable 'reign of terror' until the perpetrator is confronted by someone who risks their life, by law enforcement, or the perpetrator chooses to desist. The present invention provides a built-in non-lethal defensive system to deter, distract, and delay human threats inside of a building, public or private, commercial or home, until law enforcement arrives.

SUMMARY OF THE INVENTION

The defensive shield system uses torrents of pressurized cold water delivered through nozzles as a shield to deter, delay, and distract violent perpetrators inside of a building. The system can be plumbed in as a stand-alone system or can utilize the building fire suppression sprinkler water delivery system for cold water delivery to the nozzles. Cold water, infused with an optional eye or throat irritant or a forensic dye agent or both, becomes a defensive shield when the system is activated. System activation occurs when gunshot detection devices detect a gunshot and/or by visual recognition of a threat by building occupants.

DETAILED DESCRIPTION OF INVENTION

The defensive shield system can be activated by visual observation of an intruder and/or by a sound recognition system, such as a gunshot detection activation system.

Visual Activation of System for Commercial Application.

In one embodiment of the invention, one or more building intruder defensive shield modules are installed in entrances, hallways, offices, conference rooms, classrooms, or other areas throughout the building, as determined by the building owner. When there is a visual recognition of a threat or of an active shooter, building personnel utilize proximity sensor remote activation devices that are strategically placed throughout the building to arm and activate the building intruder defensive shield system. The proximity sensor remote activation devices are strategically placed throughout the building for quick response by building occupants. A building occupant would visually identify the intruder and the intruder's location, and activate the building intruder defensive shield in that zone. Upon activation, the proximity sensor remote activation device sends a signal to a central processing computer, which then triggers open the valve in the identified zone; spraying a timed burst of cold water throughout that zone. The preferred embodiment would have the water infused with a chemical deterrent, a forensic dye, or the like, for deterring, incapacitating or marking the intruder. Also upon activation, a building-wide lockdown alarm is sounded and the building occupants follow their lockdown procedures. A software-driven building-specific countdown to an automation stage begins. The building-specific countdown time is determined by the length of time reported by the building occupants for the building to be in full lockdown. When reaching the automation stage, strategically placed sensor devises sense movement and relay the signal to the control panel. The central processing computer opens the valves for a pre-determined time in the zones where movement is sensed. This function of the control panel creates a moving "raincloud" effect to keep the intruder distracted and moving to escape the water.

Gunshot Detection Activation of System for Commercial Application.

In another embodiment of the invention, building intruder defensive shield modules are installed in entrances, hallways, offices, conference rooms, classrooms, or other areas throughout the building, as determined by the building owner. Gunshot detection devices are strategically placed throughout the building for optimum gunshot location capabilities. When a gunshot occurs at an entrance or within the building, the gunshot detection devices relay the sound of the gunshot to a gunshot detection peripheral connected to the control panel. Detection and identification of a gunshot signature by the gunshot detection peripheral immediately provides the location of the intruder within a threatened zone.

The central processing computer activates the zone identified as the location where the gunshot occurred, sending a signal to open the valve spraying a timed burst of cold water throughout that zone. Again, the preferred embodiment would have the water infused with a chemical deterrent, a forensic dye, or the like, for deterring, incapacitating or marking the intruder. Motion detection devices in close proximity to the activated zone are immediately armed for immediate recognition of movement. A building-wide lockdown alarm is sounded and the building occupants follow their lockdown procedures. A software-driven building-specific countdown to automation begins. (This building-specific countdown time is determined by the length of time reported by the building occupants for the building to be in full lockdown.)

When reaching the automation stage, strategically placed devises sense movement and relay the signal to the control panel. The central processing computer opens the valves for a pre-determined time in the zones where movement is sensed. This function of the control panel creates a moving "raincloud" effect to keep active perpetrator distracted and moving to escape the water.

Home Invasion Protection.

In another embodiment of the invention, building intruder defensive shield modules are installed in strategic locations for maximum protection with emphasis on entrances to the home. Remote activation devices are strategically placed throughout a home to arm and activate the building intruder defensive shield system when there is a visual recognition of a threat to the health/life of a member of the family. Remote activation devices are strategically placed throughout the home for quick response by any member of the family. Upon activation, the remote activation device sends a signal to the central processing computer, which then triggers open the valve in the identified zone; spraying a timed burst of cold (optional deterrent and forensic dye laden) water throughout that zone. Upon activation, an alarm is sent to dispatch law enforcement.

The system control comprises a central processing computer, a software application means for recognizing sensor alerts, sending activation signals to a valve to turn on and off the water sprayed from the valve, a gunshot detection peripheral sensor device, a hard wired or wireless local area network (LAN) for system communication, and software applications to be used by mobile devices/wireless computers for delivery of system information to law enforcement and building occupants.

Computer hardware and software application means provide the logic and processing within the central processing computer. Commercially available gunshot detection peripheral sensor devices provide data that is processed to determine the location in or around the building of the threat. The central processing computer uses built-in logic to determine when automation of valve activation occurs, length of time zone valves are open, and timing and sequence of automated responses. All inputs and outputs are transmitted via hardwired or wireless LAN to the modules. The central processing computer produces data on the location of activated zones and detection devices, provides remote control of system, and sends data via apps to remote communication devices, such as smart phones, laptops, tablets, IPads, etc., to be used by law enforcement and building personnel.

FIG. 5 shows an embodiment of a module using a fire sprinkler water supply with multiple zone valves and multiple nozzles.

FIG. 6 shows a building footprint showing partial coverage of the building specific to entrances and hallways.

FIG. 7 shows a building footprint showing full coverage of all public use spaces in building.

Module Descriptions.

The system is module-based to accommodate any size of building. All plumbing is performed using materials consistent with local codes. Each module is connected via hard wired or wireless Local Area Network to the system control panel and consists of:

- Cold water supply line
- Cold water delivery lines
- Expansion tank
- Power supply
- Single or multiple NC (Normally Closed) Zone valves
- Single or multiple proximity sensor remote activation devices
- Relay board with control relays
- Single or multiple sensor devices
- Single or multiple nozzles
- Optional deterrent/dye metering device

DETAILED DESCRIPTION OF DRAWINGS

Figure 1:
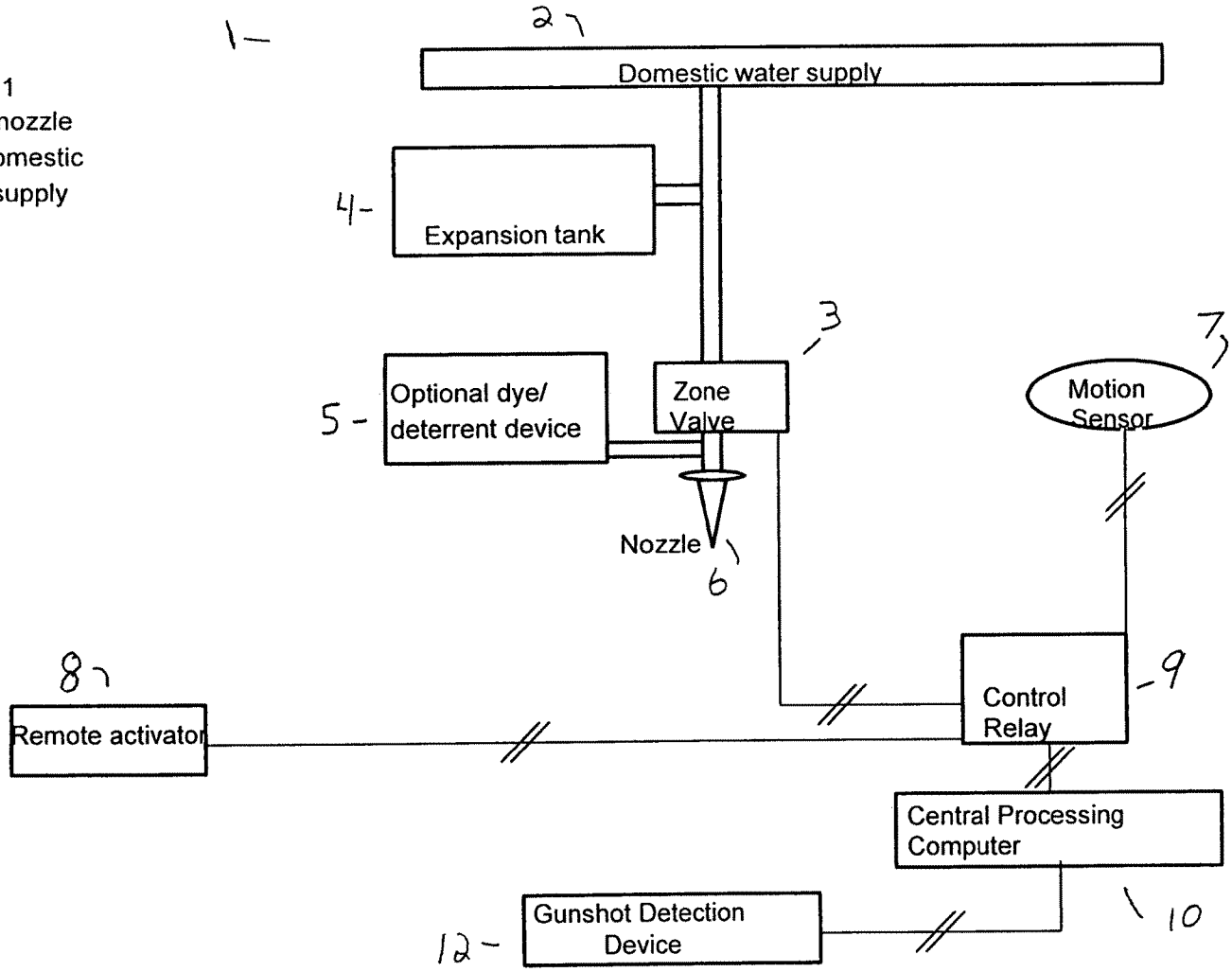
FIG. 1 shows an embodiment of a module using a domestic water supply with one zone valve and one nozzle.
Figure 2:
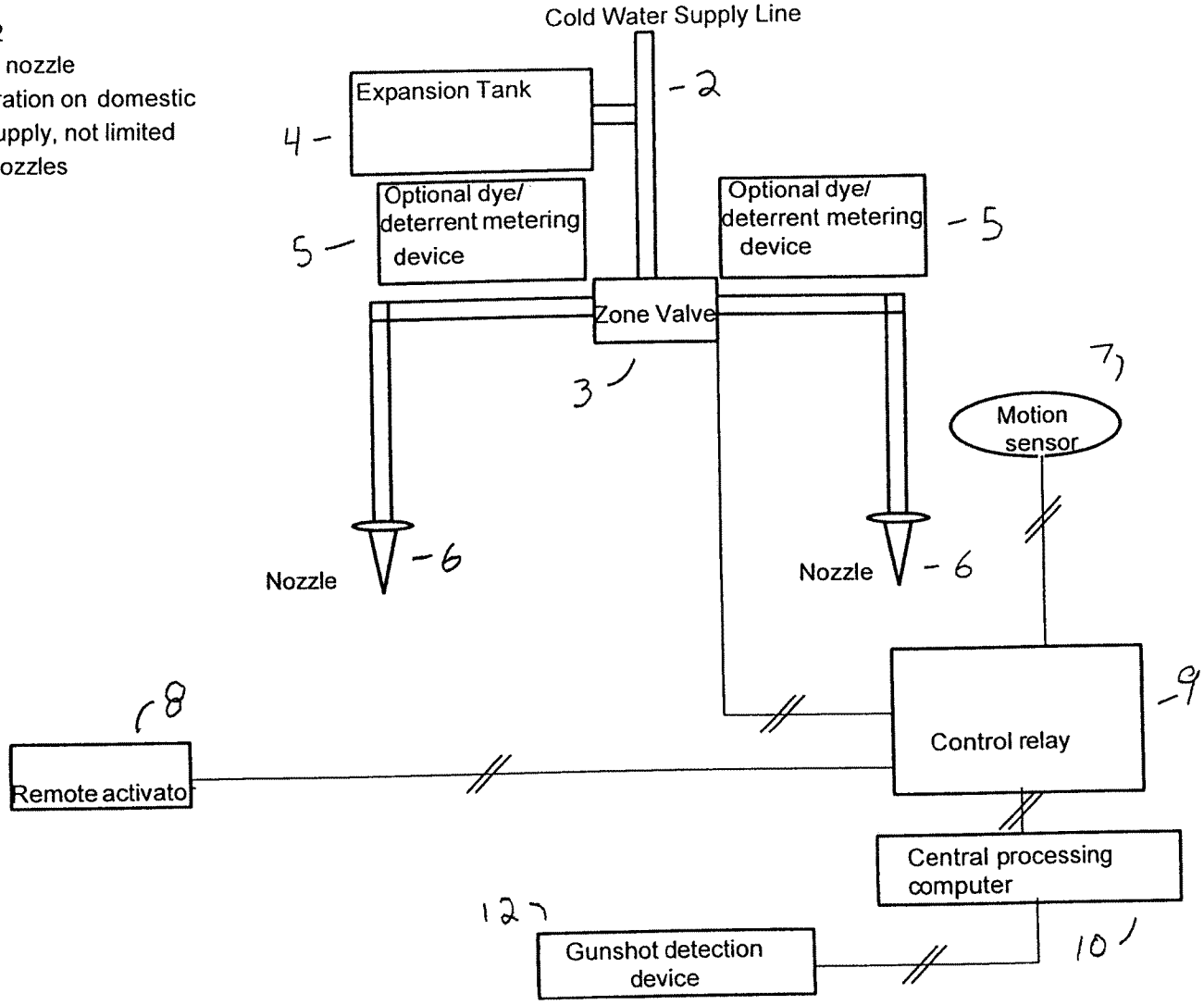
FIG. 2 shows an embodiment of a module using a domestic water supply and one zone valve and multiple nozzles.
Figure 3:
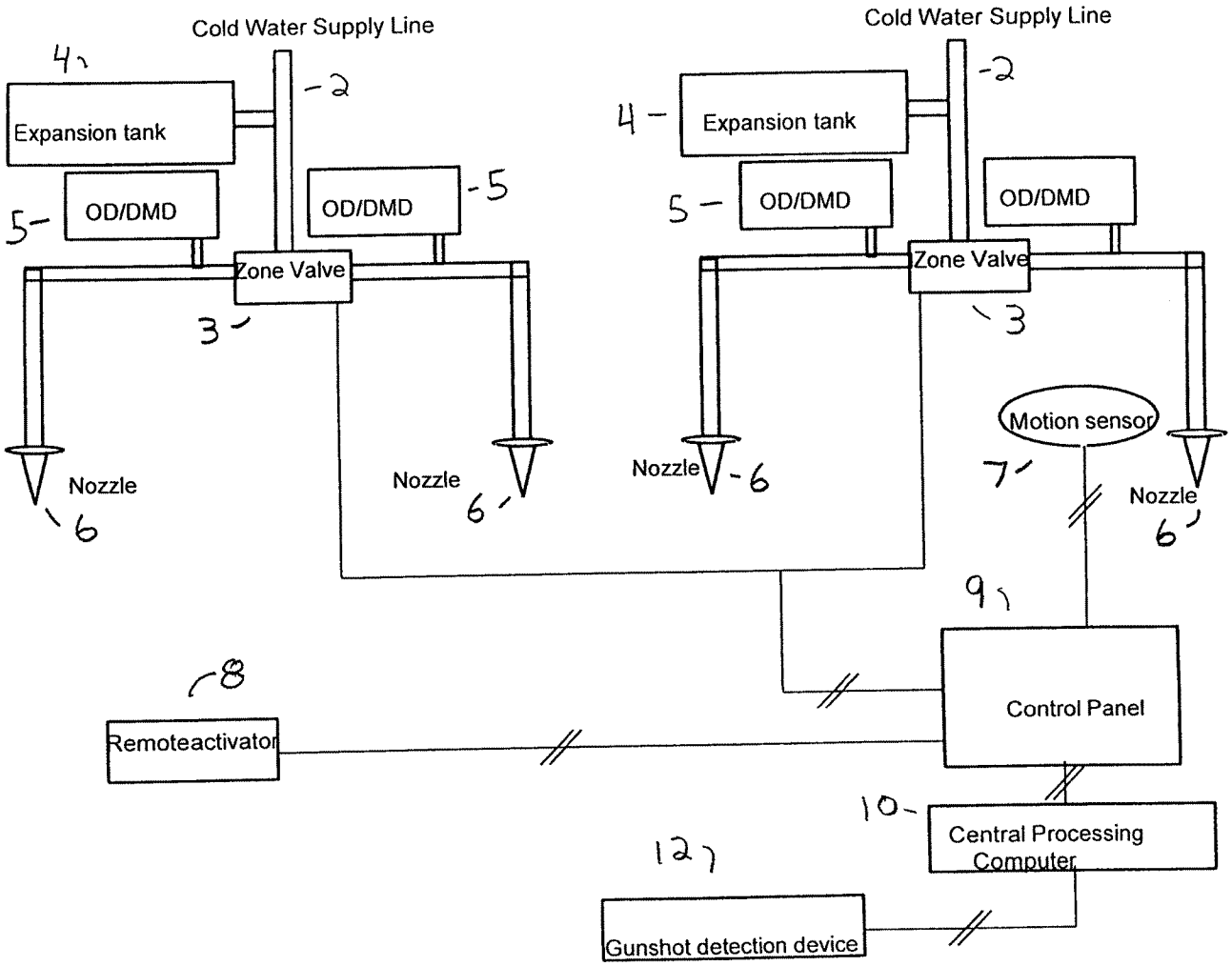
FIG. 3 shows an embodiment of a module using a domestic water supply with multiple valves and multiple nozzles.

Referring to FIGS. 1, 2 and 3, one embodiment of the module-based building intruder defensive shield 1 includes a cold water supply line 2 using the domestic water supply. The modules can be configured with one or more zone valves 3, one expansion tank 4, one or more optional deterrent/dye metering devices 5 and one or more nozzles 6 linked to one motion sensor device 7, a proximity sensor remote activation device 8, and one relay board with control relays 9 or with multiple expansion tanks 4, multiple zone valves 3, multiple optional deterrent/dye metering devices 5 and multiple nozzles 6 linked to one motion sensor device 7, a proximity sensor remote activation device 8 and one relay board with control relays 9. The control relays in each module is connected to the central processing computer 10 via hard wired or wireless Local Area Network. Each module is designed to provide coverage at one hundred or more square feet per nozzle. Nozzles have various configurations to accommodate multiple facility designs.

All plumbing is performed using materials consistent with local codes. The domestic water supply is plumbed into each expansion tank. The expansion tanks supply a pressurized volume of water to the zone valves. The zone valve is wired into the control relay. A power supply plugged into a building outlet provides the electrical current to the control relay to power the zone valve. The control relays are connected to the central processing computer via hard wired or wireless Local Area Network.

A proximity sensor remote activation device is located within eyesight of the location of the module. The proximity sensor remote activation device is connected to the central processing computer via a hardwired or wireless Local Area Network. A motion detection device is co1mected to the control relays, which are, in turn, connected to the central processing computer. The central processing computer, upon receiving a signal from any sensor, using the logic built into the software, sends a signal to the control relay, causing the zone valve or valves in the module to open, which sends the cold water through the nozzles in the module. As the water passes through the piping to the nozzle, the optional deterrent/dye metering device, located on the flow side of the zone valve to ensure non-contamination of the water supply, meters out the calculated amount of agent into the water stream. The various designs of nozzles distribute the pressurized water in a pattern designed for maximum coverage.

All plumbing is performed using materials consistent with local codes. The building's cold water supply line is plumbed to each expansion tank first. A water line is then plumbed from the expansion tank to the zone valves. The optional deterrent/dye metering device may be connected on the flow side of the zone valve to ensure there is no contamination of the supply side water. Nozzles are attached to the flow side of the valves. The nozzles are securely affixed in strategic locations in/on the ceiling and walls to ensure optimum coverage and effectiveness for each module.

Figure 4:
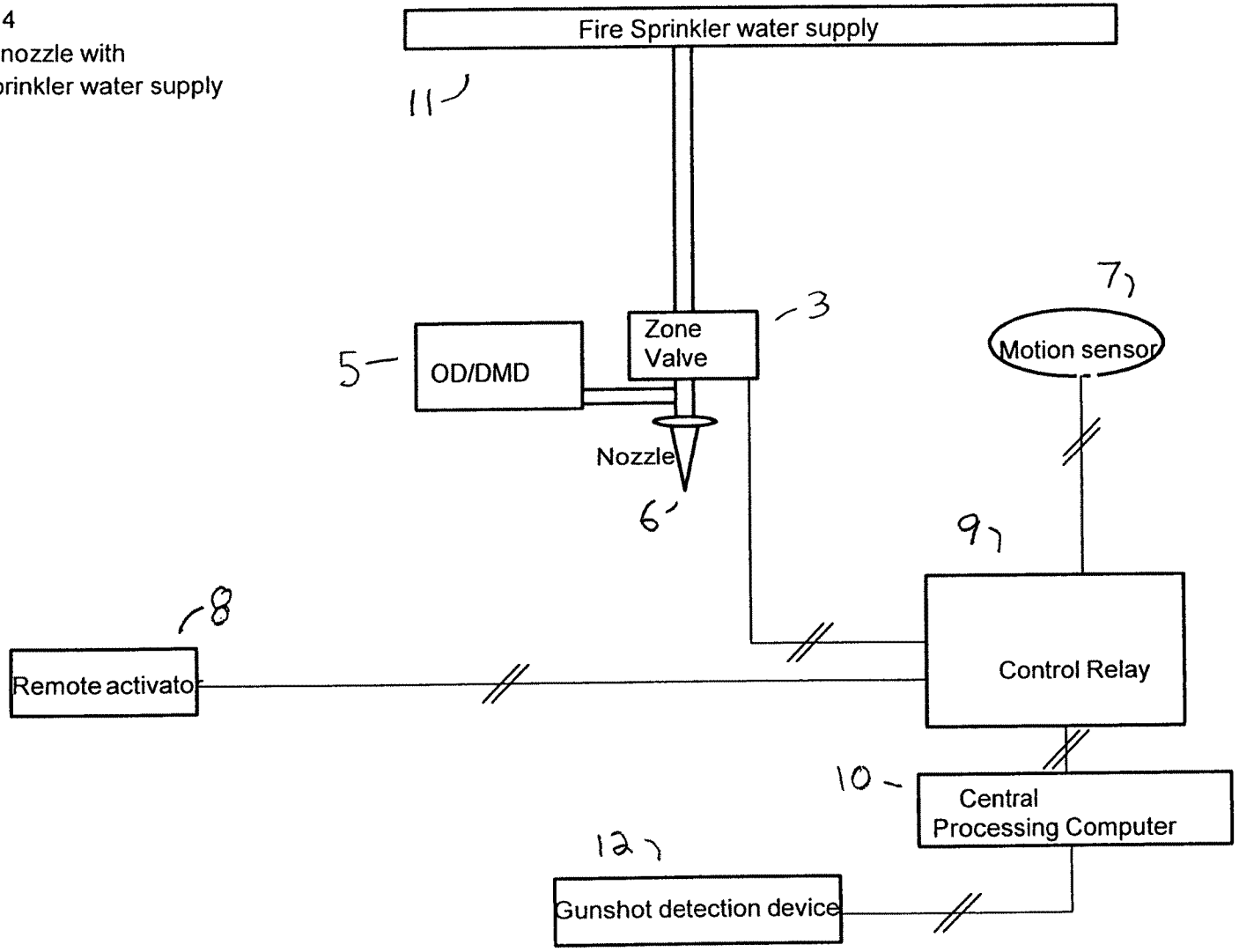
FIG. 4 shows an embodiment of a module using a fire sprinkler water supply with a single zone valve and single nozzle.

Referring now to FIGS. 4 and 5, another embodiment of the module-based invention connects the modules to the existing or new fire sprinkler system 11. The modules can be configured with one or more zone valves 3, one or more optional deterrent/dye agent metering devices 5 and one or more nozzles linked to one motion sensor device 7, a proximity sensor remote activation device 8, and one relay board with control relays 9. The control relays in each module is connected to the central processing computer 10 via hard wired or wireless Local Area Network. Each module is designed to provide coverage at one hundred or more square feet per nozzle. Nozzles have various configurations to accommodate multiple facility designs.

All plumbing is performed using materials consistent with local codes. The zone valve is plumbed into the fire sprinkler water supply system in a manner that does not impede the operation of the fire sprinkler system. The zone valve is wired into the control relay. A power supply plugged into a building outlet provides the electrical current to the control relay to power the zone valve. The control relays are connected to the central processing computer via hard wired or wireless Local Area Network.

The proximity sensor remote activation device is located within eyesight of the location of the module. The proximity sensor remote activation device is connected to the central processing computer via a hardwired or wireless Local Area Network. A motion detection device is connected to the control relays, which are, in turn, connected to the central processing computer. The central processing computer, upon receiving a signal from any sensor, using the logic built into the software, sends a signal to the control relay, causing the zone valve or valves in the module to open, which sends the cold water through the nozzles in the module. As the water passes through the piping to the nozzle, the optional deterrent/dye metering device, located on the flow side of the zone valve, meters out the calculated amount of irritant/dye into the water stream. The various designs of nozzles distribute the pressurized water in a pattern designed for maximum coverage.

When the zone valves deploy in a fire sprinkler system module, currently the fire sprinkler system water flow automatically sets off the fire alarm. In one configuration, the central processing computer will issue a lock-down alarm in conjunction with the alarm set off by the fire sprinkler system. Building occupants will be trained to adjust to the lock-down announcement. In a second configuration, an instant signal from the central processing computer will transfer the alarm from a fire alarm to a lock-down alarm. This configuration will be contingent upon local codes and local fire alarm capability to transfer the alarm from a fire alarm to a lock-down alarm.

As shown in FIGS. 1 through 5, the gunshot detection device 12 is connected to a central processing computer 10 via a hard wired or a wireless Local Area Network.

Configuration of the building intruder defensive shield within buildings is determined by the building owner. FIG. 6 shows an embodiment for full building coverage and FIG. 7 shows an embodiment for partial building coverage.

We claim:

1. A building intruder defensive system comprising:

a shield module configured to be implemented within a building, the shield module including a tank disposed within the building configured to hold pressurized fluid, the tank including a plurality of walls and an inlet configured to receive the fluid, the inlet being disposed only partially in one of the plurality of walls, a nozzle disposed within the building and configured to spray the fluid within a zone in the building, a zone valve connected to the tank and the nozzle, the zone valve being configured to regulate flow of the pressurized fluid from the tank to the nozzle, a sensing device configured to sense an initial presence of an intruder, and to output a signal indicating the initial presence of the intruder, and a processor programmed to receive the signal from the sensing device as indicating the initial presence of the intruder, to control the zone valve to cause the zone valve to open and close so as to spray the pressurized fluid through the nozzle, directly upon activation of the sensing device when the sensor senses the initial presence of the intruder, and to communicate with at least one remote device to deliver system information to at least one of law enforcement and a building occupant.

2. The building intruder defensive system of claim 1, further comprising a fluid supply including a domestic water supply.

3. The building intruder defensive system of claim 1, further comprising a fluid supply including a fire sprinkler system.

4. The building intruder defensive system of claim 1, wherein the shield module further comprises at least one deterrent metering device.

5. The building intruder defensive system of claim 4, wherein the deterrent metering device disperses at least one of a forensic dye and a chemical deterrent.

6. The building intruder defensive system of claim 1, wherein the sensing device is a motion sensing device configured to be activated by an intruder in a building.

7. The building intruder defensive system of claim 6, further wherein the sensing device is a proximity sensor in communication with the controller, and is configured to send the signal to the controller to identify a location of an intruder, the proximity sensor comprising a manual activation unit.

8. The building intruder defensive system of claim 7, wherein the proximity sensor is configured to be located in a building hallway or room to enable activation of the shield module upon identifying the intruder.

9. The building intruder defensive system of claim 1, wherein the sensing device is a gunshot detection device configured to detect a gunshot, the gunshot detection device being in communication with the controller, configured to be disposed in a building to detect and identify a gunshot signature, and to send the signal to the controller upon detecting the gunshot signature, providing a location of the gunshot.

10. A building intruder defensive system comprising:

a shield module configured to be implemented within a building, the shield module including a tank disposed within the building and configured to hold pressurized fluid, the tank including a plurality of walls and an inlet configured to receive the fluid, the inlet being disposed only partially in one of the plurality of walls, a first nozzle disposed within the building and configured to spray the fluid within a first zone in the building, a second nozzle disposed within the building and configured to spray the fluid within a second zone in the building, a zone valve connected to the tank and the first and second nozzles, the zone valve being configured to regulate flow of the pressurized fluid from the tank to at least one of the first and second nozzles, a sensing device configured to sense an initial presence of an intruder, and to output a signal indicating the initial presence of the intruder, and a processor programmed to receive the signal from the sensing device as indicating the initial presence of the intruder, to control the zone valve to cause the zone valve to open and close so as to spray the pressurized fluid through the at least one of the first and second nozzles, directly upon activation of the sensing device, when the sensor senses the initial presence of the intruder.

* * * * *